US010766671B2

(12) United States Patent
Mooney et al.

(10) Patent No.: US 10,766,671 B2
(45) Date of Patent: Sep. 8, 2020

(54) LID ASSEMBLY FOR CONTAINER

(71) Applicant: Nice-Pak Products, Inc., Orangeburg, NY (US)

(72) Inventors: Michael Mooney, Florida, NY (US); Robert P. Julius, Greenwich, CT (US)

(73) Assignee: Nice-Pak Products, Inc., Orangeburg, KY (US)

( * ) Notice: Subject to any disclaimer, the term of this patent is extended or adjusted under 35 U.S.C. 154(b) by 204 days.

(21) Appl. No.: 15/987,526

(22) Filed: May 23, 2018

(65) Prior Publication Data

US 2018/0339815 A1 Nov. 29, 2018

Related U.S. Application Data

(60) Provisional application No. 62/510,079, filed on May 23, 2017.

(51) Int. Cl.
*B65D 43/16* (2006.01)
*B65D 83/08* (2006.01)
(Continued)

(52) U.S. Cl.
CPC ..... *B65D 43/161* (2013.01); *A47K 10/421* (2013.01); *B65D 83/0805* (2013.01);
(Continued)

(58) Field of Classification Search
CPC ..... B65D 43/161; B65D 83/0894; B65D 83/0805; B65D 2251/0053;
(Continued)

(56) References Cited

U.S. PATENT DOCUMENTS

D48,897 S 4/1916 Hubbard, Jr.
D159,964 S 9/1950 Du Bois et al.
(Continued)

FOREIGN PATENT DOCUMENTS

WO WO 2016/007846 A1 1/2016
WO WO 2016/123096 A1 8/2016

OTHER PUBLICATIONS

Ted Pella. Plastic Storage Boxes. 2018 [earliest online date], [site visited Feb. 13, 2018]. Available from Internet, URL:https://www.tedpella.com/storage-boxes-bags_html/styrene-boxes.htm (Year: 2018).

*Primary Examiner* — James N Smalley
(74) *Attorney, Agent, or Firm* — Baker Botts L.L.P.

(57) ABSTRACT

Lid assembly for a container includes a frame having a frame latching member extending therefrom, the frame latching member including a frame projection, an inner panel hingedly coupled to the frame along a first longitudinal side thereof and movable between a closed position and an open position, the inner panel including a panel latching member extending therefrom, the inner panel defining an orifice extending between the bottom surface and the top surface, the panel latching member including a biasing member having a panel projection, the frame projection and the panel projection being lockable when the inner panel is in the closed position and the frame projection is disposed between a base of the biasing member and the panel projection when the inner panel is in the closed position, and a cover panel hingedly coupled to the frame along a second longitudinal side thereof opposite the first longitudinal side.

20 Claims, 19 Drawing Sheets

(51) Int. Cl.
*A47K 10/42* (2006.01)
*A47K 10/32* (2006.01)

(52) U.S. Cl.
CPC .. *B65D 83/0894* (2013.01); *A47K 2010/3266* (2013.01); *B65D 2251/0021* (2013.01); *B65D 2251/0053* (2013.01); *B65D 2251/0081* (2013.01); *B65D 2251/1058* (2013.01); *B65D 2251/1083* (2013.01); *B65D 2543/00194* (2013.01)

(58) Field of Classification Search
CPC .... B65D 2251/0081; B65D 2251/0021; B65D 2251/1083; B65D 2251/1058; B65D 2543/00194; A47K 10/421; A47K 2010/3266
USPC ..... 220/254.2, 826
See application file for complete search history.

(56) References Cited

U.S. PATENT DOCUMENTS

D182,654 S 4/1958 Glaberson
D198,946 S 8/1964 Braun
D218,401 S 8/1970 Segel
D254,842 S 4/1980 Berner
5,035,319 A 7/1991 Kunisch
D337,049 S 7/1993 Morgan et al.
D337,658 S 7/1993 Kaposvari
D352,601 S 11/1994 Dallaire
D421,902 S 3/2000 Hill
6,102,247 A 8/2000 Crawford
D447,054 S 8/2001 Hill
6,382,476 B1 5/2002 Randall et al.
6,409,044 B1 6/2002 Brown et al.
6,550,634 B1 4/2003 Alegre De et al.
6,786,447 B2 9/2004 Geib et al.
7,073,684 B2 7/2006 Decker et al.
D529,288 S 10/2006 Ham
7,172,093 B2 2/2007 Bando et al.
7,216,775 B2 5/2007 Evans et al.
7,232,040 B2 6/2007 Decker et al.
D588,914 S 3/2009 Laurieu-Tedeschi
D623,051 S 9/2010 Giraud et al.
D623,052 S 9/2010 Giraud et al.
8,016,155 B2 9/2011 Decker et al.
D656,021 S 3/2012 Dunn et al.
D677,051 S 3/2013 Wolff
D688,091 S 8/2013 Golota et al.
D694,575 S 12/2013 Andres et al.
D721,578 S 1/2015 Julius et al.
D729,062 S 5/2015 Julius et al.
9,272,831 B2 3/2016 Julius et al.
9,327,892 B2 5/2016 Rubo et al.
D759,378 S 6/2016 West et al.
D795,056 S 8/2017 Zeitlin et al.
D800,550 S 10/2017 Zeitlin et al.
2016/0031632 A1 2/2016 Ripberger et al.
2016/0113450 A1 4/2016 Yamada
2017/0101256 A1 4/2017 Zeitlin et al.
2017/0150852 A1 6/2017 Park 1000
130
115
112
110
100
132
310
304
300
200
210

| Events | Control | A | B | C | E | F | G |
|---|---|---|---|---|---|---|---|
| Roping Avg | 15 | 0 | 0 | 0 | 0 | 0 | 1 |
| Long Tail Avg | 4 | 0 | 0 | 0 | 0 | 0 | 0 |
| Tear Avg | 0 | 0 | 2 | 0 | 0 | 0 | 0 |
| Clumping Avg | 1 | 1 | 2 | 2 | 2 | 1 | 2 |

LID ASSEMBLY FOR CONTAINER

CROSS-REFERENCE TO RELATED APPLICATION

The present application claims the benefit of U.S. Provisional Application No. 62/510,079 filed on May 23, 2017, the contents of which is incorporated herein by reference in its entirety.

BACKGROUND OF THE DISCLOSED SUBJECT MATTER

Field of the Disclosed Subject Matter

The disclosed subject matter generally relates to containers for dispensing articles, including for dispensing sheets of material, such as wipes.

BACKGROUND

Containers can be configured for dispensing sheets of material, such as nonwoven material used for cleaning. Such material can be circular, oval or rectangular in shape, and can be stored as a roll or in individual sheets or wipes, and can be stored interleaved, as discrete sheets, perforated or separably connected in a container. The material can be packaged dry, or can be packaged moistened with a cleaning solution or lotion, for example to produce wet wipes. Conventional containers for such material can include boxes, stand-up containers, canisters or the like, and can be configured as a unitary piece with an orifice to dispense the sheets of material therethrough. Such containers can be rigid, or can be made from a relatively flexible material, such as a resin material.

The container can further include a separate lid assembly attached thereto. The orifice of the container can thus be covered by the lid assembly, which can be opened by, for example, being cut along a perforated edge, having an adhesive that may be sealed and unsealed repeatedly, or by having a hinged cover that can be opened and closed repeatedly. In this manner, the lid can be opened to allow access to the interior of the container to allow the sheets of material to be individually fed through an orifice in the lid and can be closed to keep the material sanitary and moist.

A disadvantage of such containers is that removal of material can deform the lid assembly, which can cause the closure mechanism of the lid assembly to become loose and/or can decrease the effectiveness of the lid orifice to control dispensing of material. Further deformation can cause such closure mechanisms to fail, thus preventing the lid from being secured in a closed position over the container. In some conventional containers, the lids have been known to entirely detach from the container.

Another disadvantage of such containers is that the orifice size can affect the dispensing of the material. That is, an orifice that is too small can cause individual sheets of material to tear when pulled out through the orifice. On the other hand, an orifice that is too large can cause the sheets of material to clump or rope when pulled out through the orifice.

Thus, there remains a continued need for improved containers, including lid assemblies for containers for dispensing sheets of material, including wipes. The presently disclosed subject matter satisfies these and other needs. Embodiments of the disclosed subject matter provide a container with an improved lid assembly to reclosably cover the container and dispense sheets of material therefrom. Additionally, lid assemblies described herein can include improved orifice configurations to control dispensing of material, for example, to dispense sheets of material individually without tearing, roping or clumping.

SUMMARY

The purpose and advantages of the disclosed subject matter will be set forth in and are apparent from the description that follows, as well as will be learned by practice of the disclosed subject matter. Additional advantages of the disclosed subject matter will be realized and attained by the devices particularly pointed out in the written description and claims hereof, as well as from the appended drawings.

To achieve these and other advantages and in accordance with the purpose of the disclosed subject matter, as embodied and broadly described, the disclosed subject matter includes a lid assembly for a container. The lid assembly includes a frame including an exterior surface, the exterior surface having a frame latching member extending outwardly therefrom, where the frame latching member includes a frame projection, an inner panel hingedly coupled to the frame along a first longitudinal side thereof and movable between a closed position and an open position, the inner panel including a bottom surface, a top surface, and a sidewall extending outwardly from a perimeter of the top surface, the top surface having a panel latching member extending outwardly therefrom, the inner panel defining an orifice extending between the bottom surface and the top surface, wherein the panel latching member includes a biasing member having a panel projection, wherein the frame projection and the panel projection are lockable when the inner panel is in the closed position and the frame projection is disposed between a base of the biasing member and the panel projection when the inner panel is in the closed position to lock the inner panel with the frame, and a cover panel hingedly coupled to the frame along a second longitudinal side thereof opposite the first longitudinal side.

In accordance with another aspect of the disclosed subject matter, a lid assembly for a container is provided. The lid assembly includes a frame, an inner panel operatively coupled to the frame along a first longitudinal side thereof and moveable between a closed position and an open position, the inner panel including a bottom surface and a top surface, the inner panel including a first finger, a second finger, and a third finger, where the first finger, the second finger, and the third finger define a first orifice between the bottom surface and the top surface of the inner panel, and a cover panel operatively coupled to the frame along a second longitudinal side thereof.

It is to be understood that both the foregoing general description and the following detailed description and drawings are examples and are provided for purpose of illustration and not intended to limit the scope of the disclosed subject matter in any manner.

The accompanying drawings, which are incorporated in and constitute part of this specification, are included to illustrate and provide a further understanding of the devices of the disclosed subject matter. Together with the description, the drawings serve to explain the principles of the disclosed subject matter.

BRIEF DESCRIPTION OF THE DRAWINGS

The subject matter of the application will be more readily understood from the following detailed description when read in conjunction with the accompanying drawings, in which.

DETAILED DESCRIPTION

Reference will now be made in detail to embodiments of the disclosed subject matter, an example of which is illustrated in the accompanying drawings. The disclosed subject matter will be described in conjunction with the detailed description of the system.

In accordance with the disclosed subject matter, a lid assembly for a container is provided. The lid assembly includes a frame including an exterior surface, the exterior surface having a frame latching member extending outwardly therefrom, where the frame latching member includes a frame projection, an inner panel hingedly coupled to the frame along a first longitudinal side thereof and movable between a closed position and an open position, the inner panel including a bottom surface, a top surface, and a sidewall extending outwardly from a perimeter of the top surface, the top surface having a panel latching member extending outwardly therefrom, the inner panel defining an orifice extending between the bottom surface and the top surface, wherein the panel latching member includes a biasing member having a panel projection, wherein the frame projection and the panel projection are lockable when the inner panel is in the closed position and the frame projection is disposed between a base of the biasing member and the panel projection when the inner panel is in the closed position to lock the inner panel with the frame, and a cover panel hingedly coupled to the frame along a second longitudinal side thereof opposite the first longitudinal side.

Figure 1A:
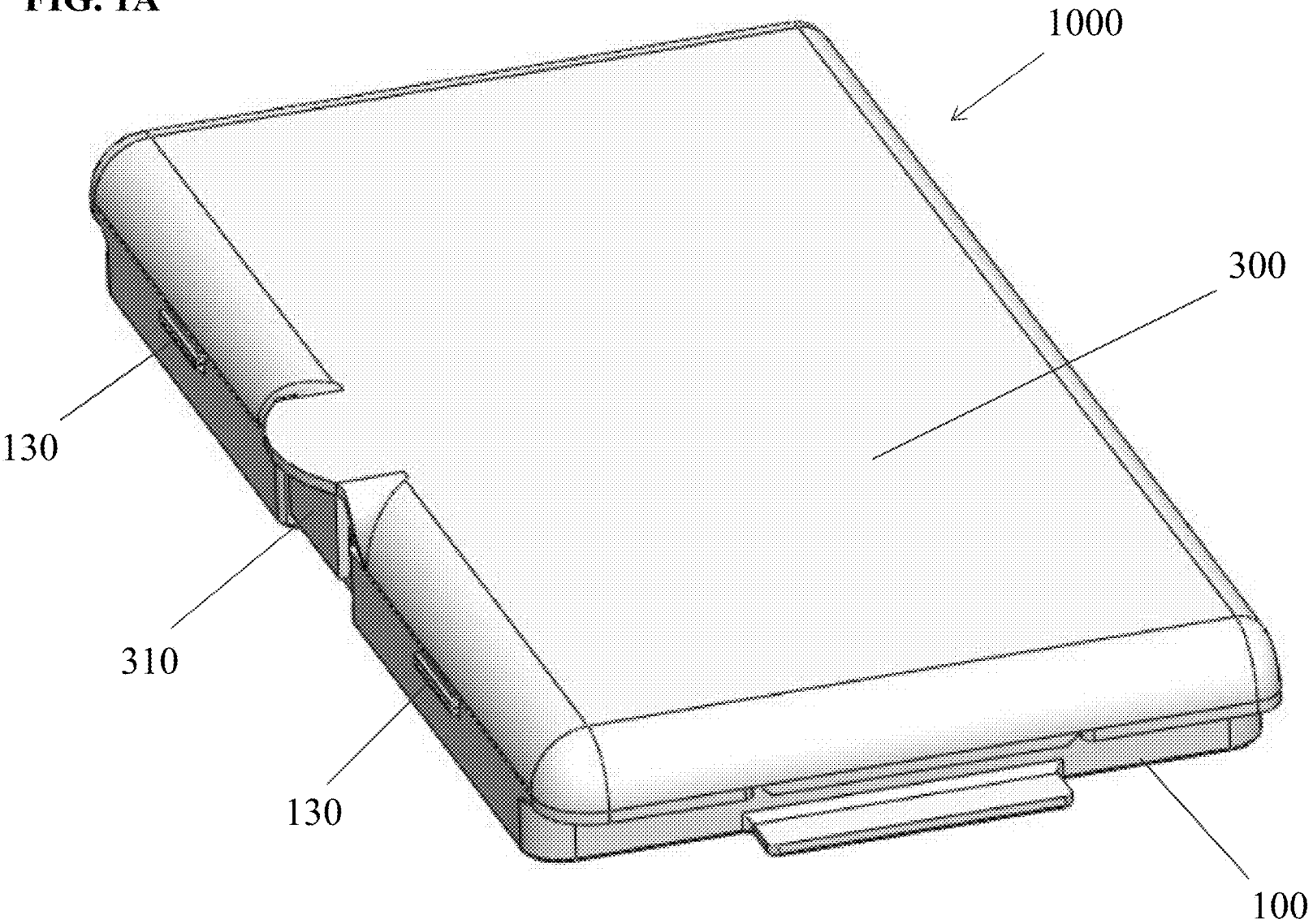
FIG. 1A is a top-right perspective view of a lid assembly, with the inner panel and the cover panel in a closed position, according to the disclosed subject matter.
Figure 1B:
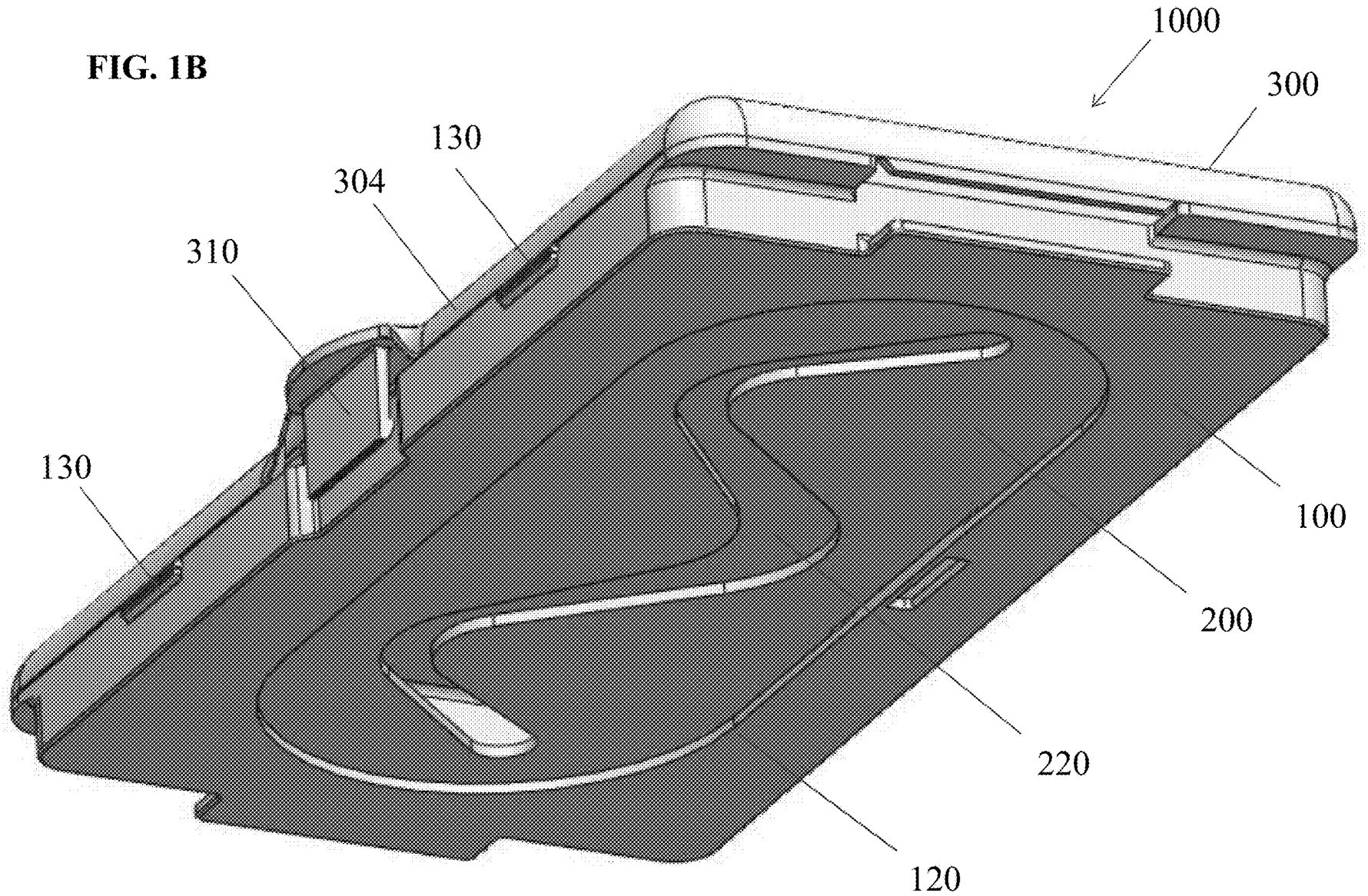
FIG. 1B is a bottom-right perspective view of the lid assembly of FIG. 1A, according to the disclosed subject matter.
Figure 2:
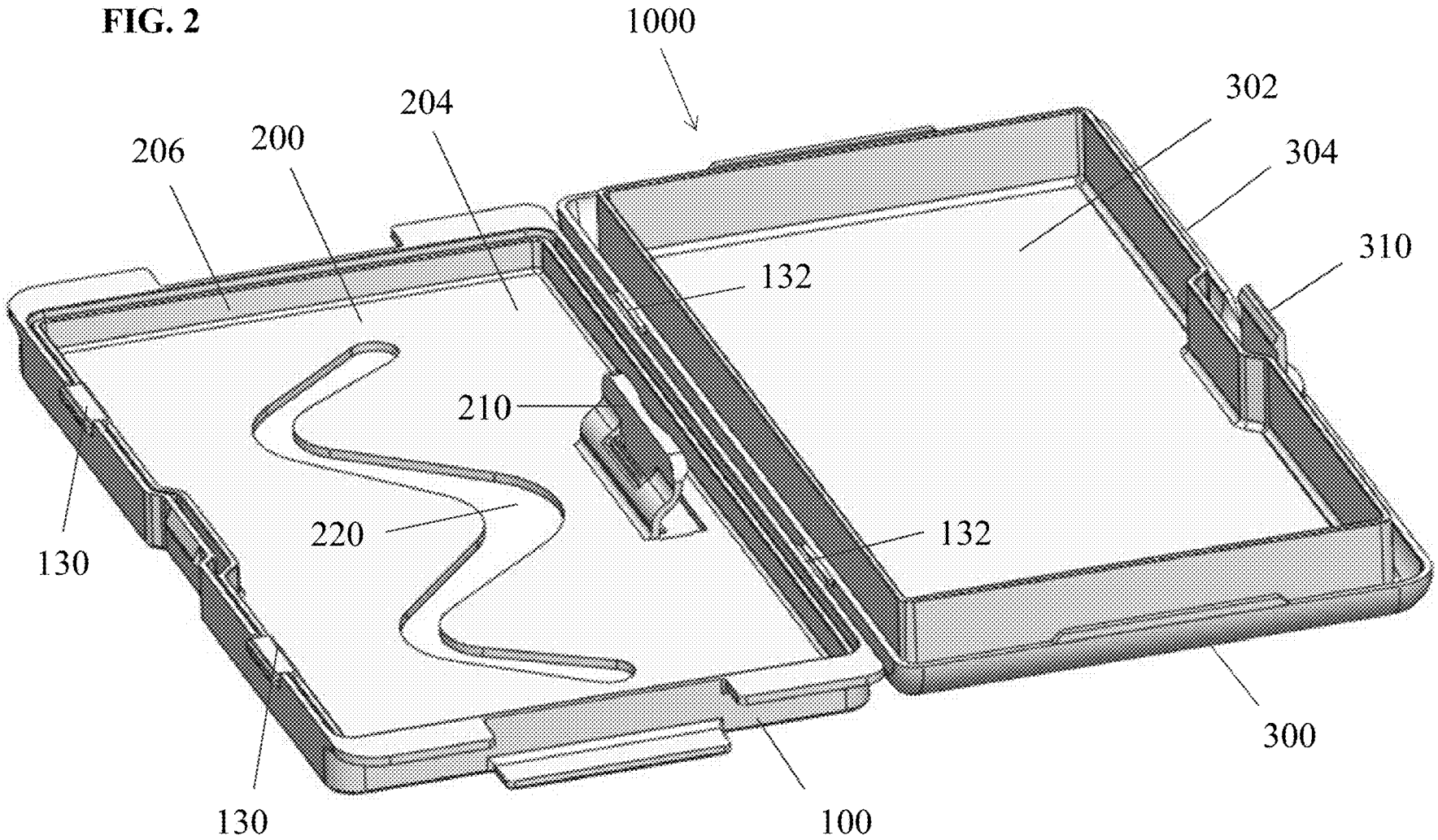
FIG. 2 is a top-right perspective view of the lid assembly of FIG. 1A, with the cover panel in an open position and the inner panel in a closed position, according to the disclosed subject matter.

Solely for purpose of illustration, an embodiment of a lid assembly 1000 is shown in FIGS. 1A-3G. The examples herein are not intended to limit the scope of the disclosed subject matter in any manner. With reference to FIGS. 1A and 1B, lid assembly 1000 generally includes a frame 100, an inner panel 200 and a cover panel 300. FIGS. 1A and 1B depict lid assembly 1000 with inner panel 200 and cover panel 300 each in a closed position. FIG. 2 depicts lid assembly 1000 with inner panel 200 in the closed position and cover panel 300 in an open position. FIGS. 3A-3G depict lid assembly 1000 with inner panel 200 and cover panel 300 each in the open position.

Particularly, and as illustrated in FIGS. 3A-3G, lid assembly 1000 includes a frame 100 having an exterior surface 102. A frame latching member 110 extends outwardly from exterior surface 102 of frame 100. Frame latching member 110 includes a frame projection 112 configured to engage a corresponding latching member of inner panel 200 to lock inner panel 200 in the closed position relative frame 100, as described further herein. As embodied herein, frame projection 112 can include a cammed surface 115 configured to engage a corresponding cammed surface of inner panel 200 when inner panel 200 is urged toward the closed position.

For purpose of illustration and not limitation, as embodied herein, frame 100 defines an orifice 120 defined therein. Orifice 120 can align with a corresponding orifice defined in inner panel 200 to allow sheets of material to be dispensed therethrough, as described further herein.

Additionally, and as embodied herein, frame 100 can include a frame sidewall 106 extending about a perimeter thereof. Frame sidewall 106 can define a projection 114 therein. Projection 114 can be configured to engage a latching member of cover panel 300 to lock cover panel 300 in the closed position relative frame 100, as described further herein.

With continued reference to FIGS. 3A-3G, lid assembly 1000 includes inner panel 200 hingedly coupled to frame 100 along a first longitudinal side 103 of frame 100. For purpose of illustration and not limitation, inner panel 200 can be hingedly coupled to frame 100 by any suitable hinge configuration, embodied herein as living hinge 130. Additionally or alternatively, inner panel 200 can be hingedly coupled to frame 100 by a butterfly hinge, a bi-fold hinge, a butt hinge, a concealed hinge, and/or a continuous hinge or the like.

Figure 3A:
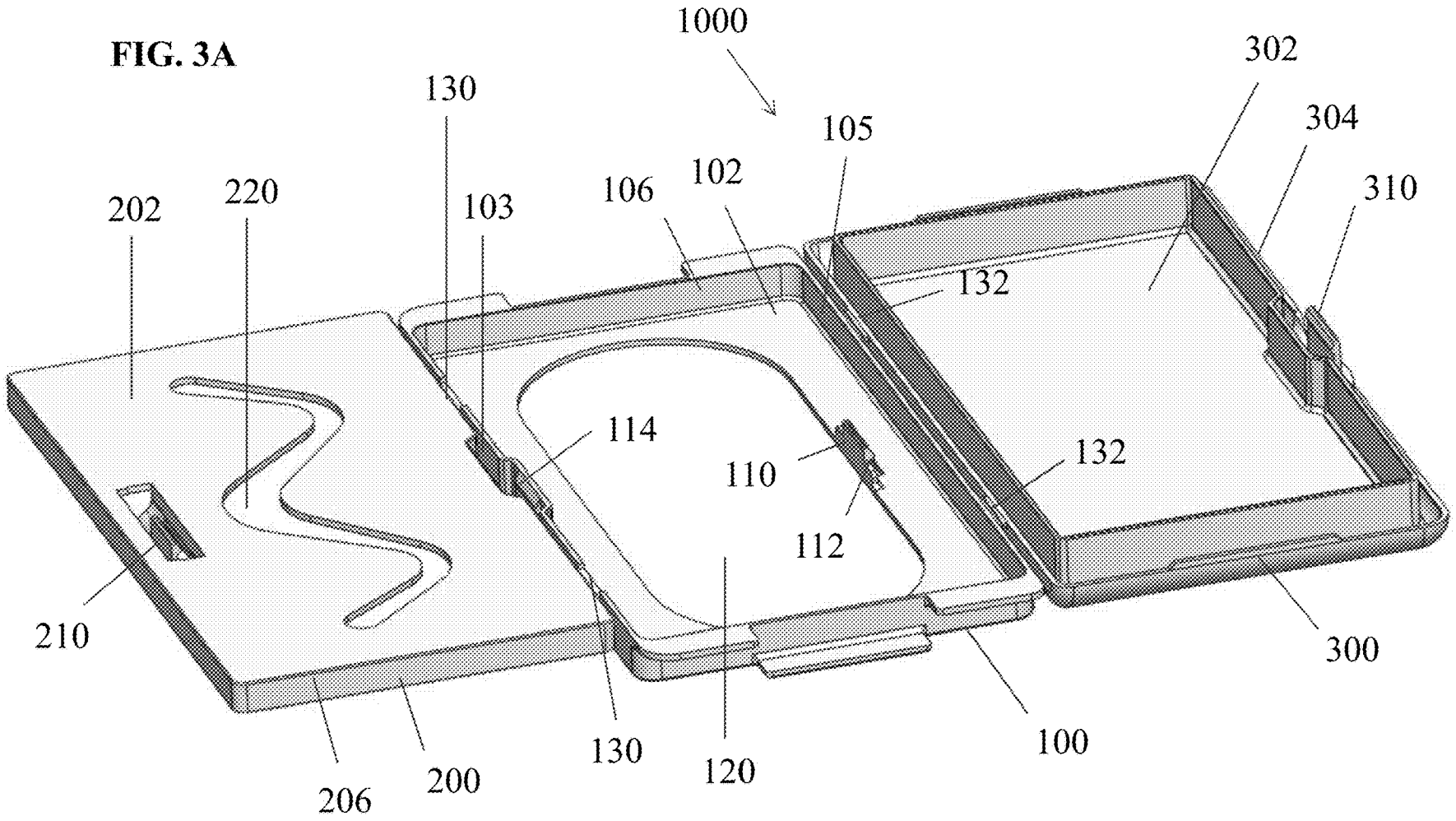
FIG. 3A is a top-right perspective view of the lid assembly of FIG. 1A, with the cover panel and the inner panel in an open position, according to the disclosed subject matter.
Figure 3B:
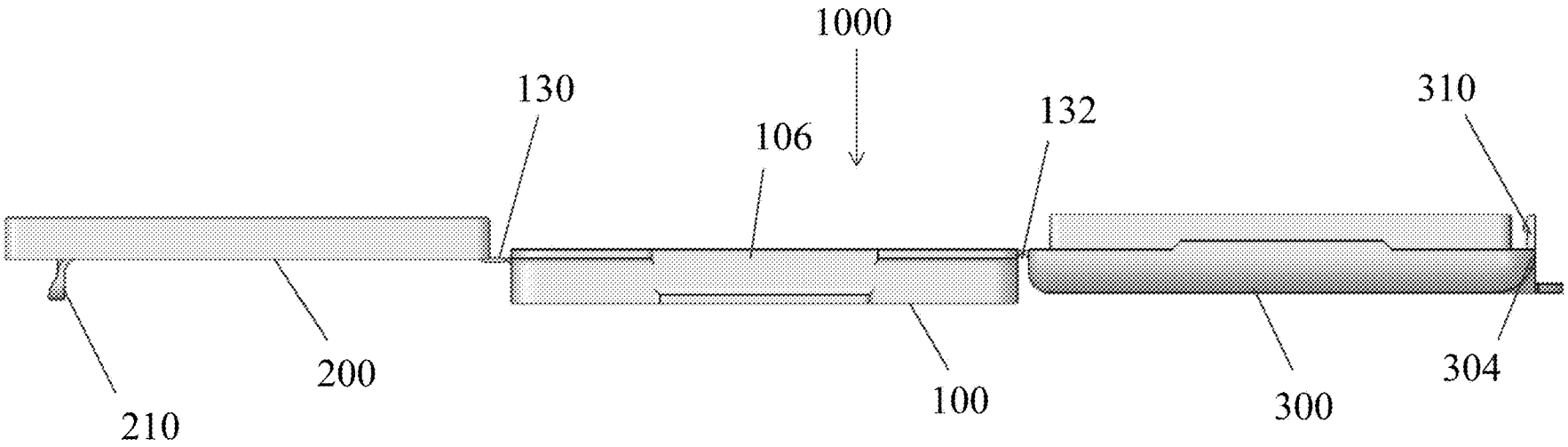
FIG. 3B is a right side view of the lid assembly of FIG. 3A, according to the disclosed subject matter.
Figure 3C:
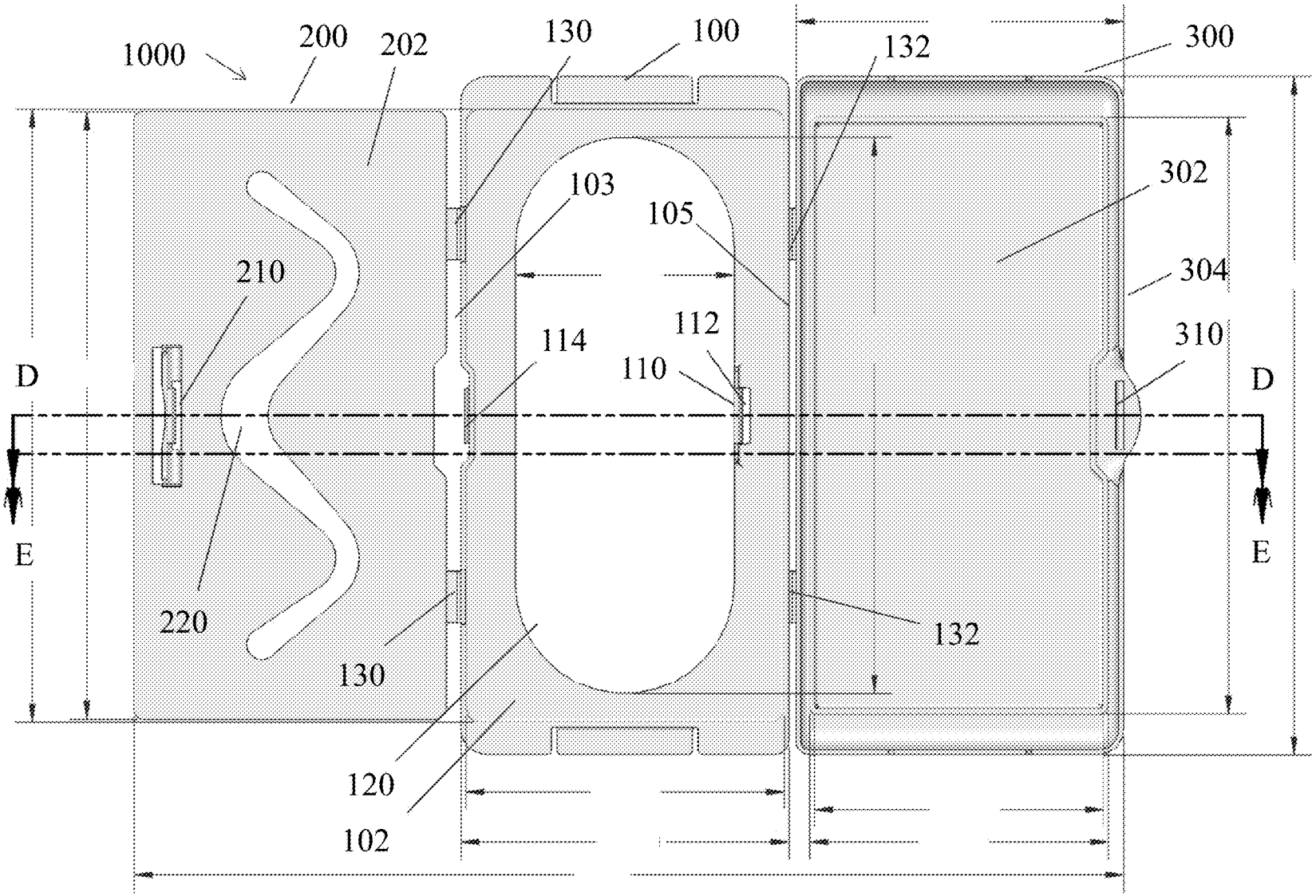
FIG. 3C is a top view of the lid assembly of FIG. 3A, according to the disclosed subject matter.
Figures 3D, 3E:
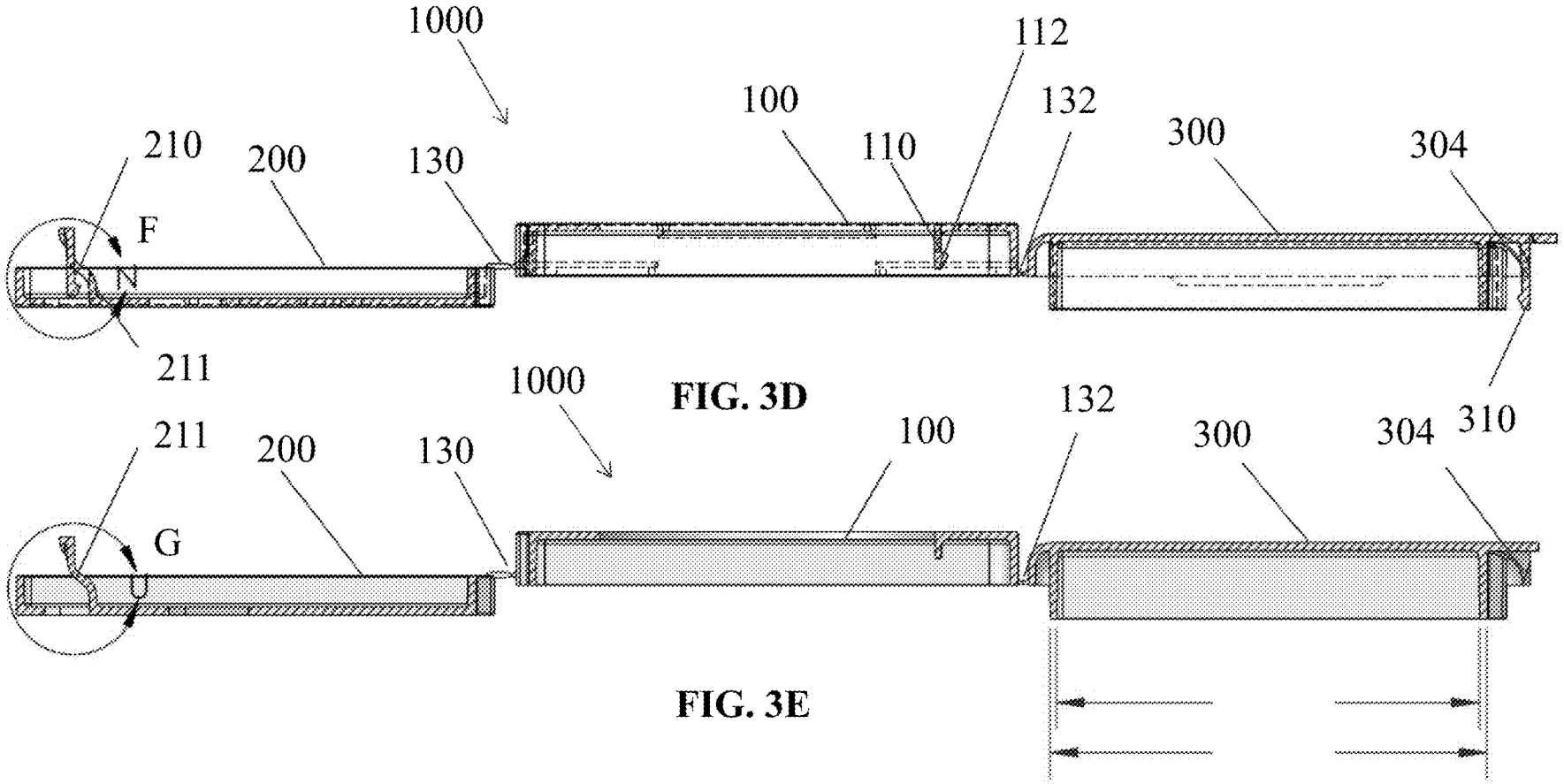
FIG. 3D is a cross-sectional view of the lid assembly taken along line D-D of FIG. 3C, according to the disclosed subject matter.
FIG. 3E is a cross-sectional view of the lid assembly taken along line E-E of FIG. 3C, according to the disclosed subject matter.
Figure 3G:
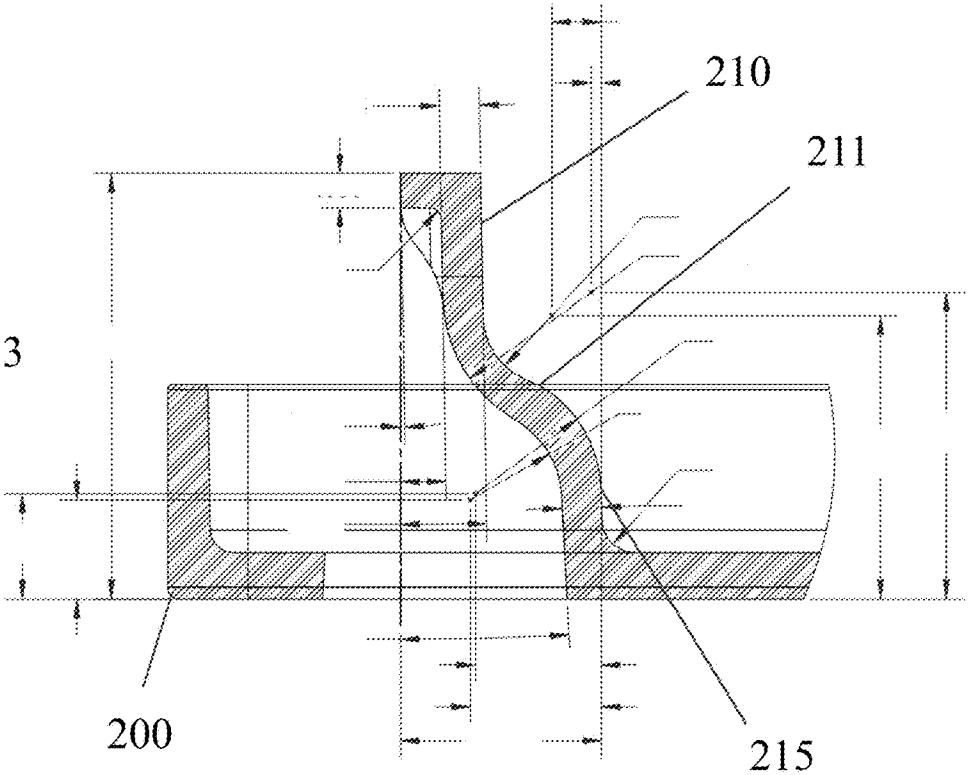
FIG. 3G is an enlarged cross-sectional view of region G of FIG. 3E.
Figure 3F:
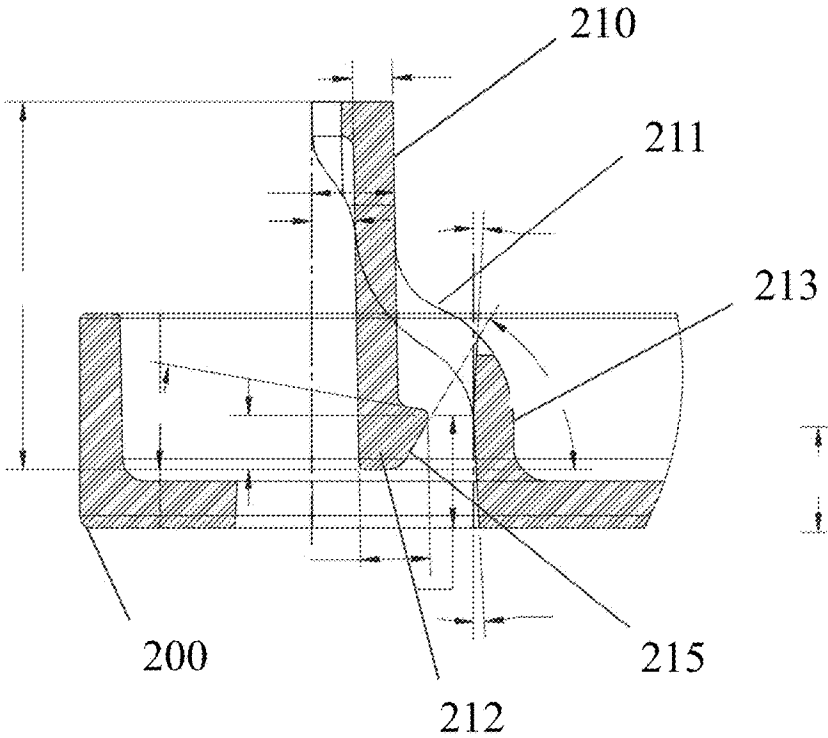
FIG. 3F is an enlarged cross-sectional view of region F of FIG. 3D.

As embodied herein, inner panel 200 includes a bottom surface 202, a top surface 204, and a sidewall 206 extending outwardly from a perimeter of top surface 204. Top surface has a panel latching member 210 extending outwardly therefrom. As best shown in FIG. 3F, panel latching member 210 includes a biasing member 211 having a panel projection 212 and a base 213. Frame projection 112 and panel projection 212 are configured to engage and interlock when inner panel 200 is in the closed position with frame projection 112 disposed between base 213 of biasing member 211 and panel projection 212 when inner panel 200 is in the closed position, thereby locking inner panel 200 with frame 100. As embodied herein, panel projection 212 can include a cammed surface 215 configured to engage cammed surface 115 of frame projection 112 when inner panel 200 is urged toward the closed position, as described further herein. In the closed position, as embodied herein, inner panel 200 can be sized to be disposed within sidewall 106 of frame 100.

Additionally, and as embodied herein, inner panel 200 can define an orifice 220 extending between bottom surface 202 and top surface 204. Orifice 220 can be configured to control dispensing of sheets of material dispensed therethrough, for example, to reduce or prevent roping, clumping or tearing, as described further herein. In this manner, orifice 220 can be configured to align with orifice 120 of frame 100 when inner panel 200 is in the closed position. For purpose of illustration and not limitation, as embodied herein, orifice 120 of frame 100 can be larger than orifice 220 of inner panel 200. As such, a surface area of frame 100 can be less than a surface area of inner panel 200.

Referring still to FIGS. 3A-3G, lid assembly 1000 includes cover panel 300 hingedly coupled to frame 100 along a second longitudinal side 105 of frame 100 opposite first longitudinal side 103. For purpose of illustration and not limitation, cover panel 300 can be hingedly coupled to frame 100 by any suitable hinge configuration, embodied herein as living hinge 132. Additionally or alternatively, cover panel 300 can be hingedly coupled to frame 100 by a butterfly hinge, a bi-fold hinge, a butt hinge, a concealed hinge, and/or a continuous hinge and the like.

As embodied herein, cover panel 300 includes an inner surface 302 and a free end 304 opposite living hinge 132. Cover panel 300 includes a cover latching member 310 extending outwardly from inner surface 302. For purpose of illustration and not limitation, as embodied herein, cover latching member 310 can be disposed along or proximate to free end 304. For example, and as embodied herein, cover latching member 310 can be configured to engage and lock with projection 114 of frame 100 when inner panel 200 is in the closed position to lock cover panel 300 in engagement with frame 100.

Lid assembly 1000 can be configured to be coupled to a container for containing sheets of material, such as wipes. Examples of such containers include, but are not limited to, containers described in International Publication No. WO 2016/123096 entitled, "Canister and Bracket System and Method" and containers as described in International Publication No. WO 2016/007846 entitled "Container Integration Device and Method of Use," the contents of each of which is herein incorporated by reference in its entirety.

For purpose of illustration and not limitation, frame 100 can be joined to a container for containing wipes, as embodied herein, by sealing frame 100 to the container opposite exterior surface 102. Frame 100 can be sealed to the container by any suitable technique, for example and not limitation, by an adhesive, clip, latch, tape, rivet or any other suitable technique. As embodied herein, frame 100 can be sealed to container with orifice 120 of frame 100 and orifice 220 of inner panel 200 aligned with an opening of the container to dispense sheets of material therethrough. The opening of the container can be defined by perforations having a removable central area. The removable central area can be coupled with, or alternatively integral to, a pull tab to detach the removable central area and to define the opening of the container.

Figures 4A, 4B, 4C:
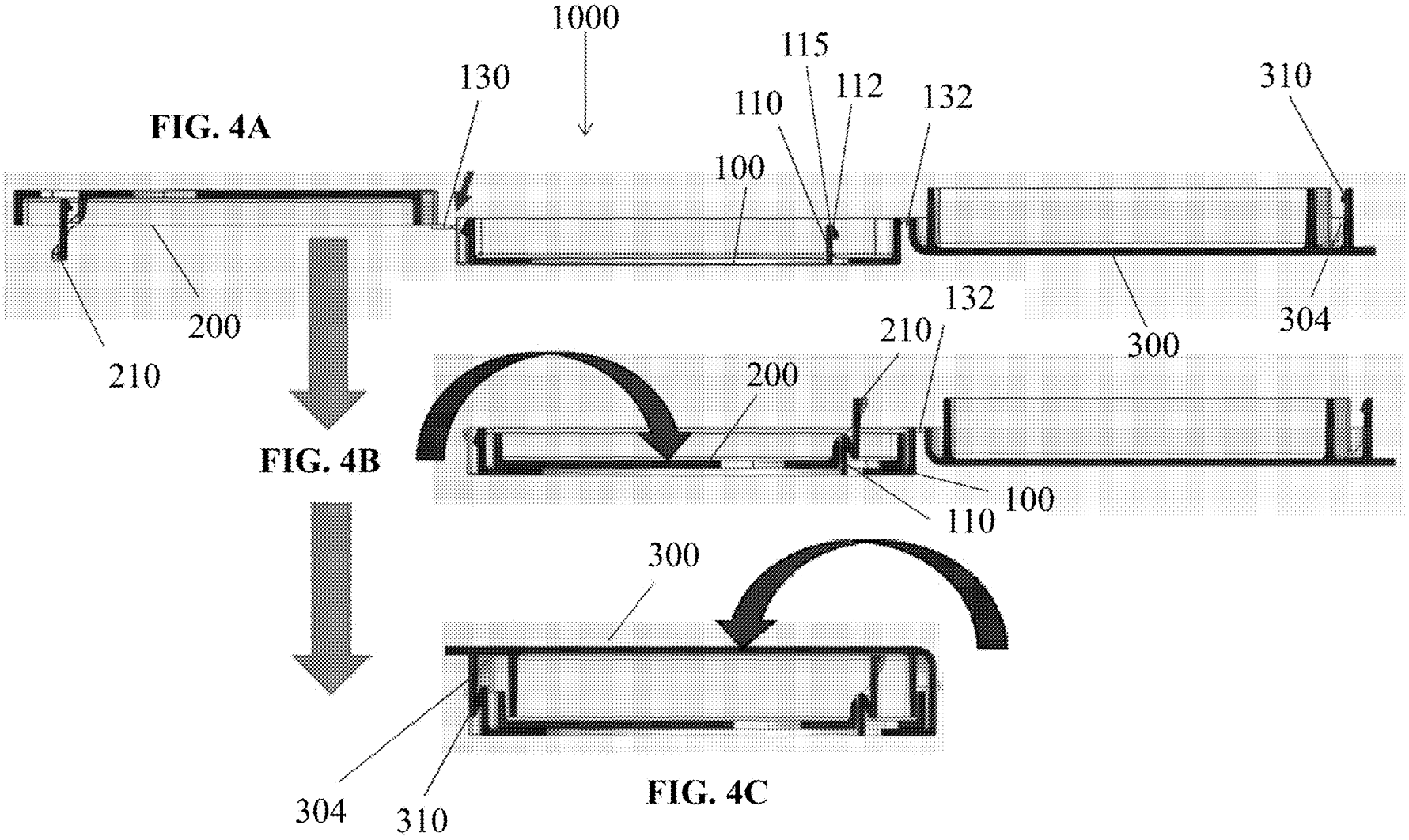
FIGS. 4A-4C are a schematic diagram of the lid assembly of FIG. 1A, illustrating moving the inner panel and the cover panel each from an open position to a closed position, according to the disclosed subject matter.

FIGS. 4A-4C are a schematic diagram illustrating movement of the inner panel 200 and cover panel 300 from the open position to the closed position. For purpose of illustration and not limitation, as shown, inner panel 200 is rotated about living hinge 130 into engagement with frame 100. As inner panel 200 is urged toward frame 100, cammed surface 115 of frame projection 112 engages and slides along cammed surface 213 of panel projection 212, as shown for example in FIGS. 7A-7B. As inner panel 200 is further urged toward frame 100, frame latching member 110 and/or panel latching member 210 can flex to allow panel projection 212 to be disposed below and in interlocking engagement with frame projection 112. In this configuration, with frame 100 secured to a container containing sheets of material, the sheets can be disposed through orifice 120 of frame 100 and orifice 220 of inner panel 200 by pulling the sheets therethrough.

Referring to FIG. 4B and FIG. 4C, with inner panel 200 in the closed position, cover panel 300 is rotated about living hinge 132 into engagement with frame 100. As cover panel 300 is urged toward frame 100, cammed surface 315 of cover projection 312 engages and slides along cammed surface 116 of projection 114, as shown for example in FIG. 6. As cover panel 300 is further urged toward frame 100, projection 114 and/or cover latching member 310 can flex to allow cover projection 312 to be disposed below and in interlocking engagement with projection 114.

Figure 5:
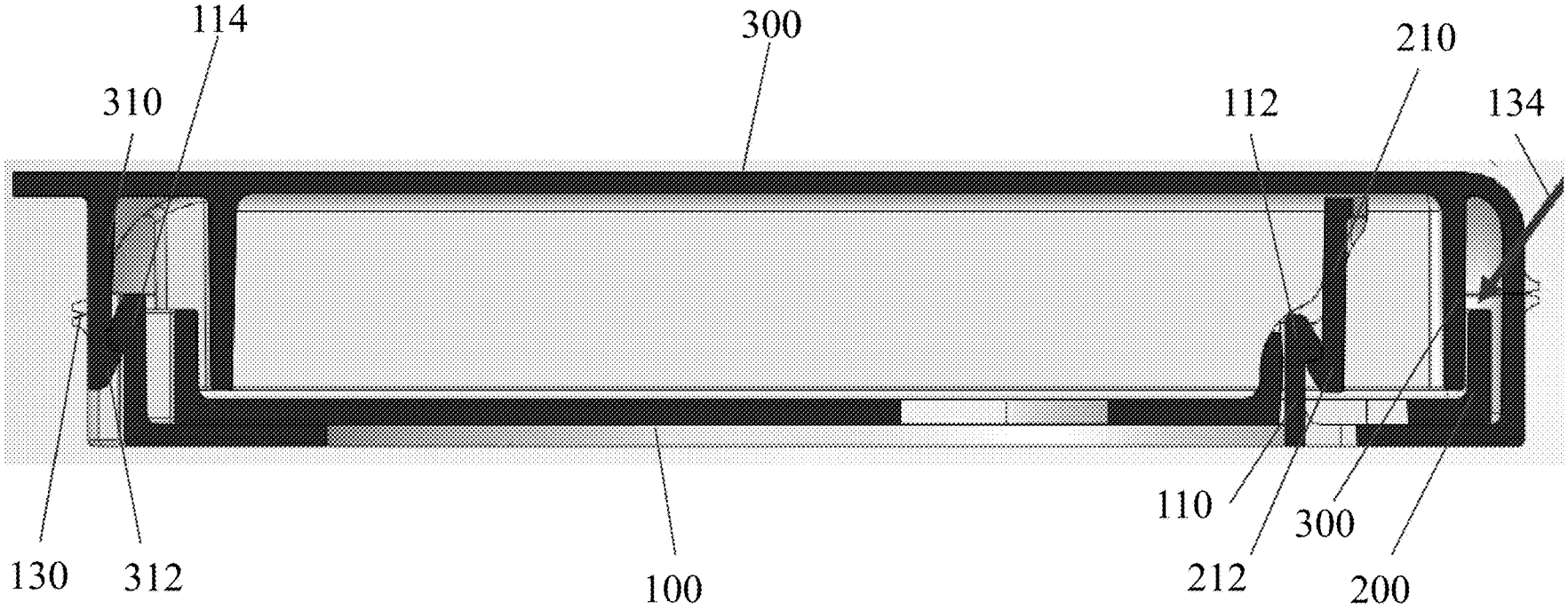
FIG. 5 is a schematic diagram of the lid assembly of FIG. 1A, illustrating the inner panel in the cover panel each in a closed position, according to the disclosed subject matter.

FIG. 5 is a schematic diagram illustrating inner panel 200 and cover panel 300 in the closed position. For purpose of illustration and not limitation, as embodied herein, in the closed configuration, a tortuous path 134 is formed between cover panel 300 and inner panel 200, which can seal orifices 120, 220 within cover panel 300. In this configuration, cover panel 300 can thus seal the opening of the container to prevent unwanted access to sheets of material therein, to prevent exposure of the sheets of material to debris and/or to prevent drying out of the sheets of material if provided in a moistened condition.

Figure 6:
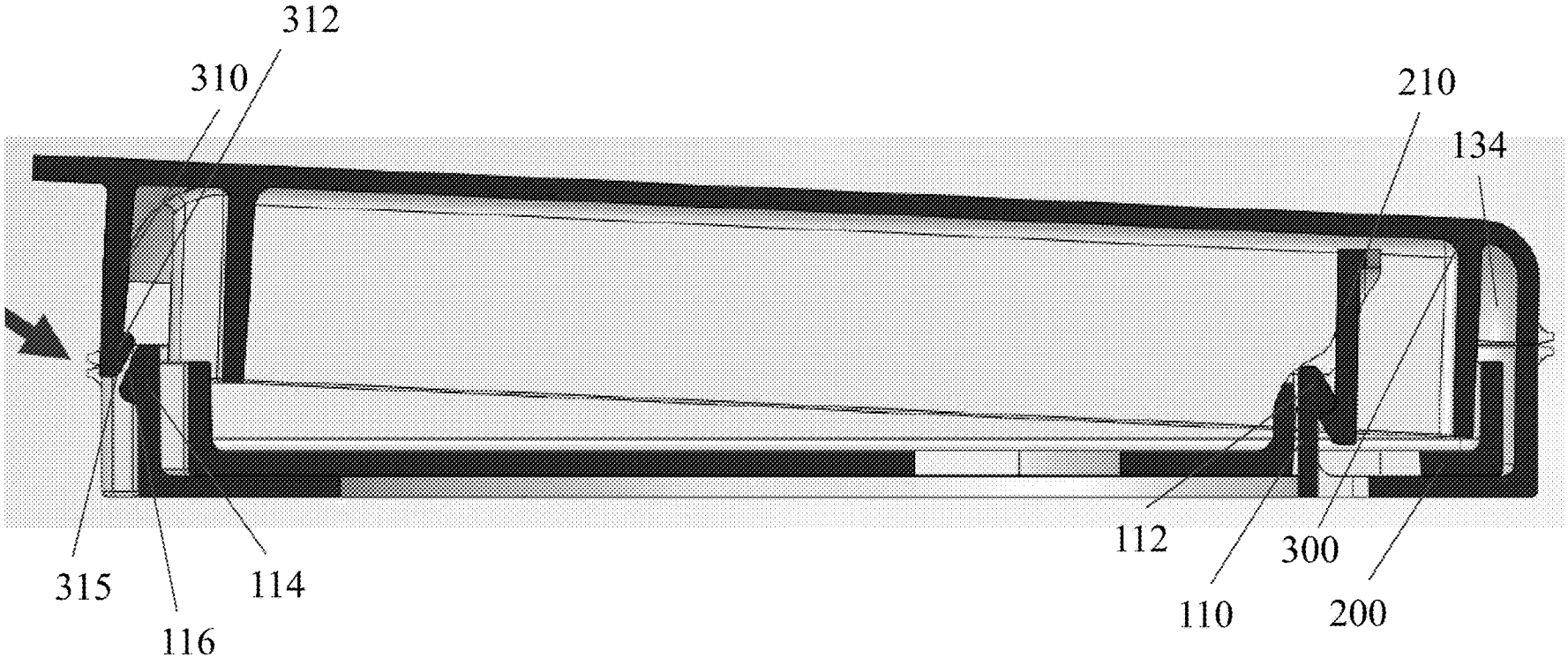
FIG. 6 is a schematic diagram of the lid assembly of FIG. 1A, illustrating the inner panel in the closed position and the cover panel in a partially open position, according to the disclosed subject matter.

To move cover panel 300 from the closed position to the open position, cover latching member 310 can be urged outward from frame 100 to move cover projection 312 out of engagement and alignment with projection 114. FIG. 6 is a schematic diagram illustrating inner cover panel 300 in a partially open position with cover projection 312 disposed above projection 114. Cover panel 300 can be rotated away from frame 100 about living hinge 132 to allow access to sheets of material through orifices 120, 220 and the opening of the container. In this configuration, orifice 220 of inner panel 200 remains aligned with orifice 120 of frame 100 to allow dispensing of sheets of material therethrough. As discussed further herein, orifice 220 of inner panel 200 can be configured to control dispensing of sheets, for example and without limitation, to provide dispensing of individual sheets of material while reducing or preventing roping, clumping or tearing of the sheets.

Figure 7A:
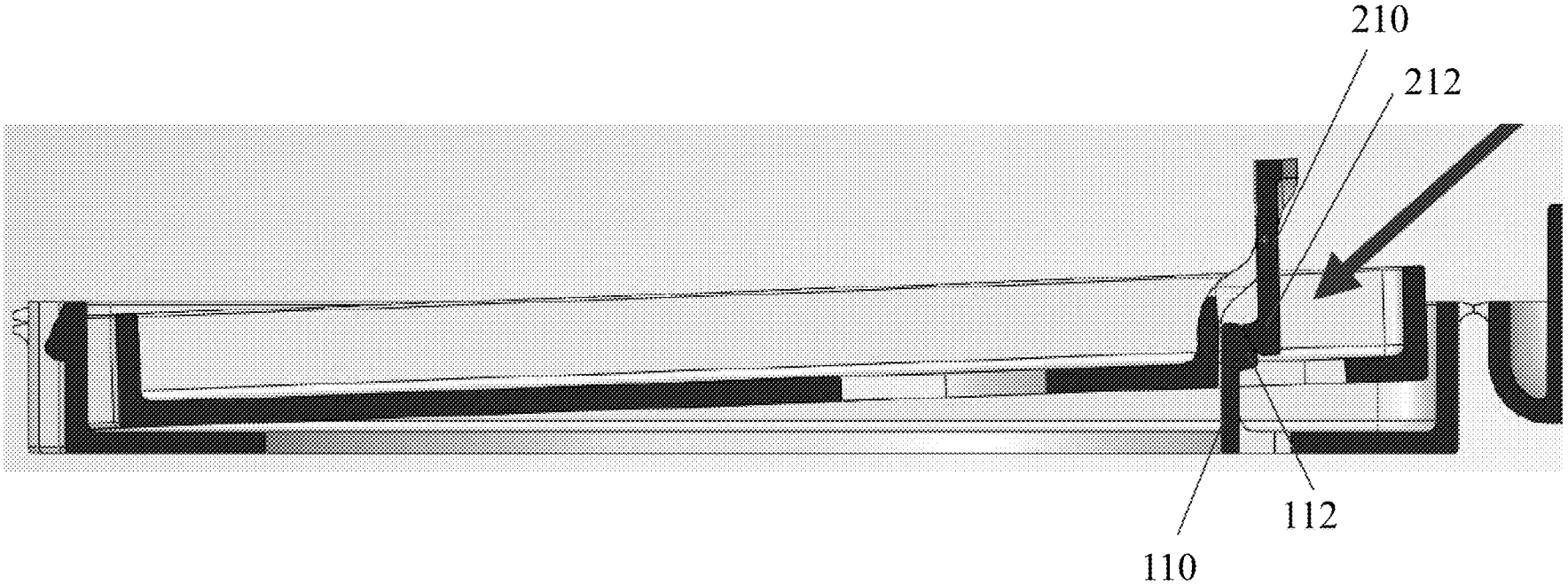
FIG. 7A is a schematic diagram of a portion of the lid assembly of FIG. 1A, illustrating the inner panel in a partially open position and the cover panel in an open position, according to the disclosed subject matter.
Figure 7B:
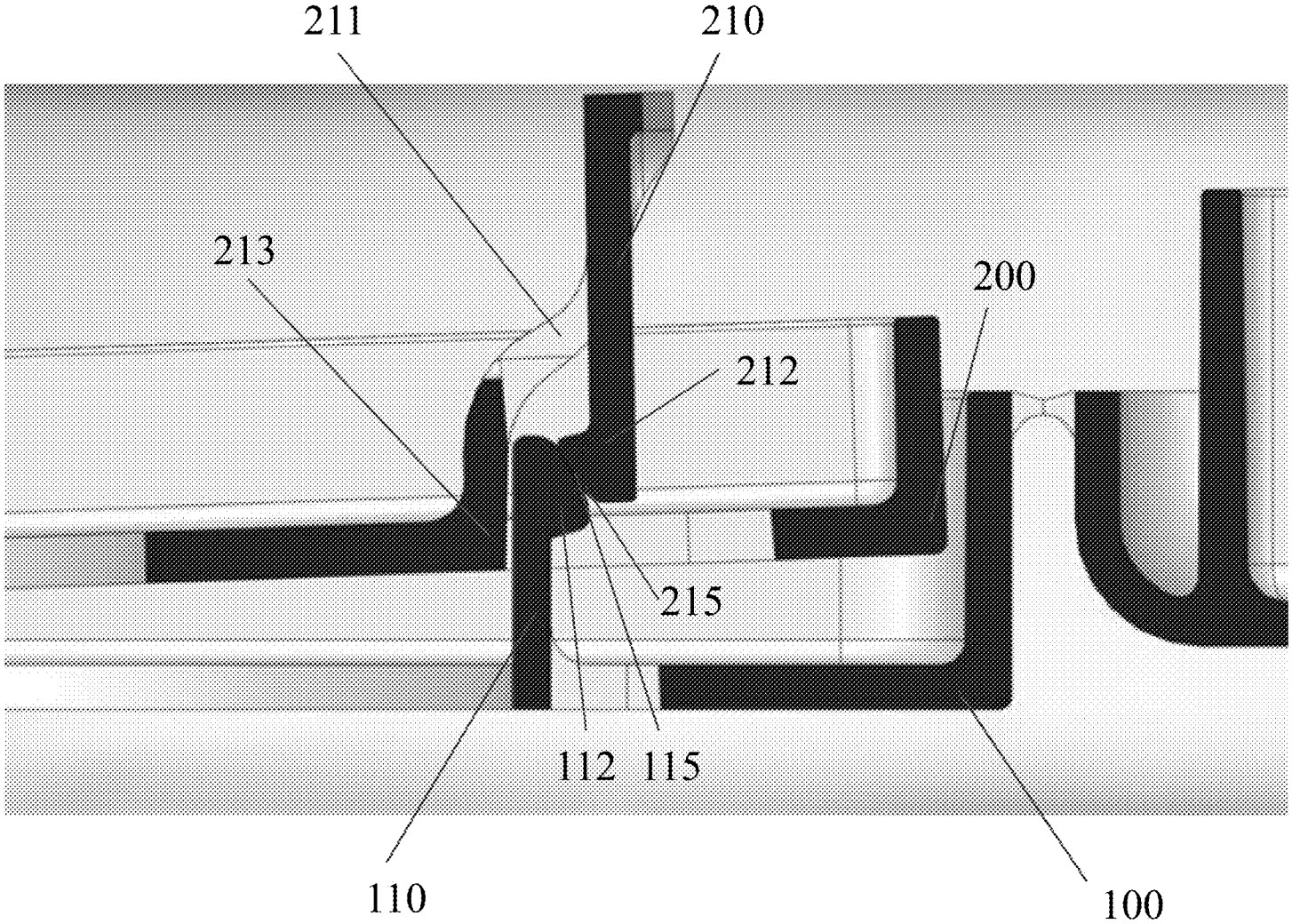
FIG. 7B is an enlarged schematic diagram of the frame locking member, the panel locking member and the biasing member of FIG. 7A.
Figure 8:
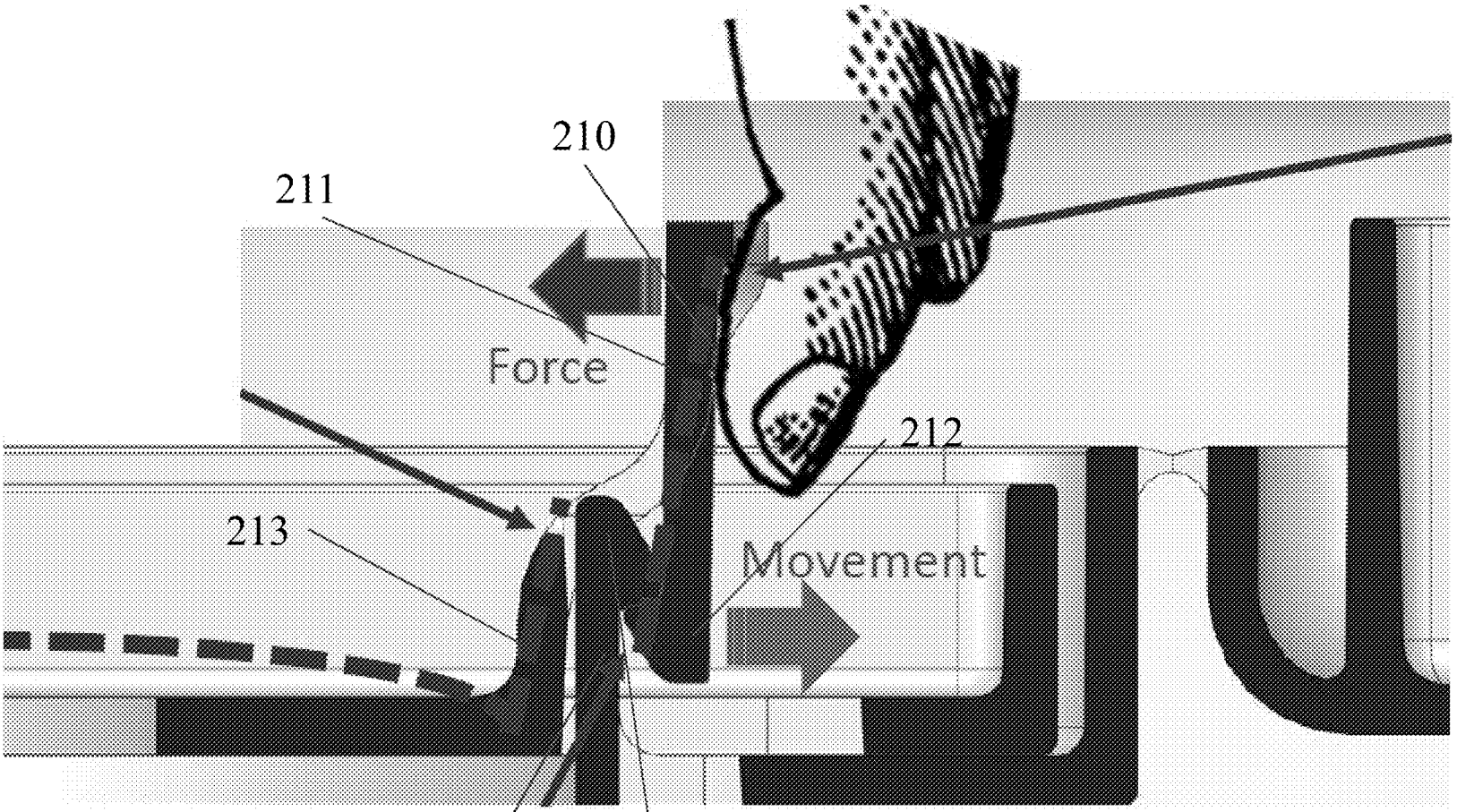
FIG. 8 is a schematic diagram of a portion of the lid assembly of FIG. 1A, illustrating operation of the frame projection, the panel projection and the biasing member, according to the disclosed subject matter.
Figure 9:
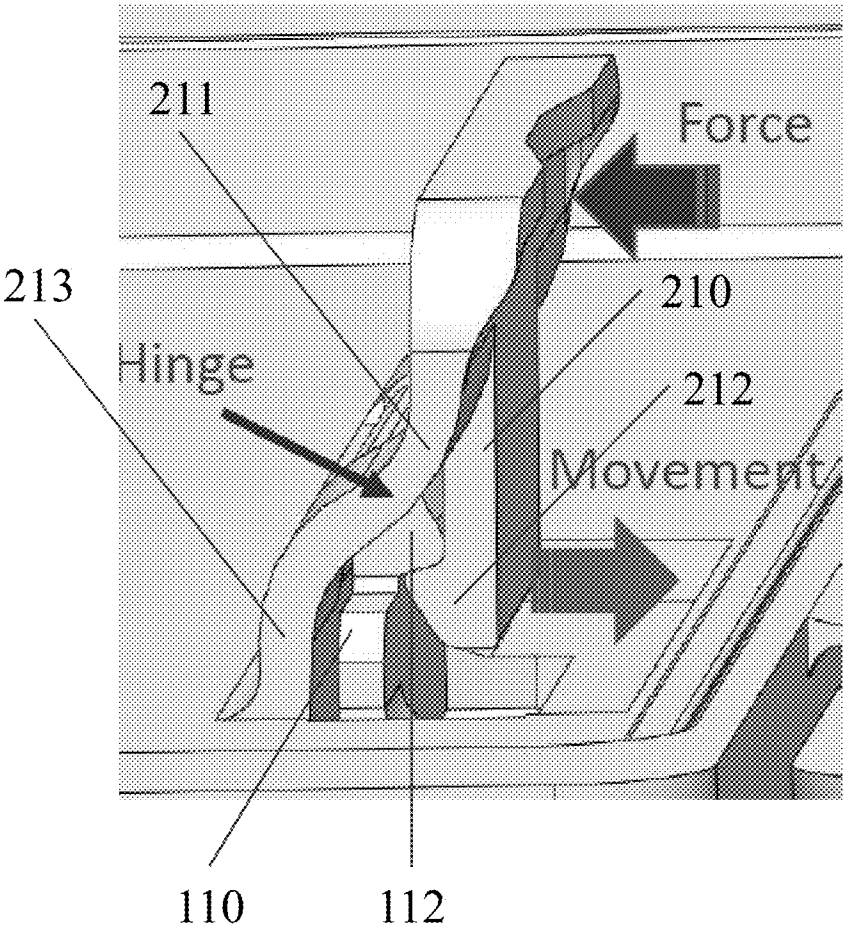
FIG. 9 is a schematic diagram of a portion of the lid assembly of FIG. 1A, illustrating operation of the frame projection, the panel projection and the biasing member, according to the disclosed subject matter.

To move inner panel 200 from the closed position to the open position, panel latching member 210 can be urged outward from frame 100 to move panel projection 212 out of engagement and alignment with frame projection 112. FIGS. 7A-7B are schematic diagrams illustrating inner panel 200 in a partially open position with panel projection 212 disposed above frame projection 112. FIGS. 8 and 9 are schematic diagrams illustrating the operation of panel latching member 210 and biasing member 211. As shown for example in FIGS. 8 and 9, biasing member 211 can be urged inward toward frame latching member 110 to flex panel projection 212 out of engagement and alignment with frame projection 112. Inner panel 200 can be rotated away from frame 100 about living hinge 130 to move inner panel 200 to the open position. In this configuration, orifice 220 of inner panel 200 is out of alignment with orifice 120 of frame 100 to allow feeding of initial or additional sheets of material through orifice 120 and then through orifice 220.

Referring still to FIGS. 8 and 9, when sheets of material are dispensed through orifice 220, engagement of the sheets with boundaries of orifice 220 can cause inner panel 200 to bow upwards and can urge biasing member 211 toward frame latching member 110 as shown in the dashed line above the inner panel. This can thereby urge the panel projection 212 further toward engagement with frame projection 112. As such, deformation due to dispensing sheets through orifice 220 can thus maintain engagement of inner panel 200 with frame 100. Such configuration prevents any gaps or dislodging between the interfacing projections of the panel projection 212 and the frame projection 112.

In accordance with another aspect of the disclosed subject matter, a lid assembly for a wipe container is provided. The lid assembly includes a frame, an inner panel operatively coupled to the frame along a first longitudinal side thereof and moveable between a closed position and an open position, the inner panel including a bottom surface and a top surface, the inner panel including a first finger, a second finger, and a third finger, where the first finger, the second finger, and the third finger define a first orifice between the bottom surface and the top surface of the inner panel, and a cover panel operatively coupled to the frame along a second longitudinal side thereof.

As described herein, inner panel 200 has an orifice 220 defined therein. Orifice 220 can be configured to control dispensing of sheets, for example and without limitation, to provide dispensing of individual sheets of material while reducing or preventing roping, clumping or tearing of the sheets. Orifice 220 can have any suitable configuration to allow sheets of material to pass therethrough, and can be configured to separate individual sheets from a chain of sheets, if so configured, and/or to feed additional sheets through orifice 220 to allow the additional sheets to be pulled through orifice 220 for dispensing when desired.

Figure 10:
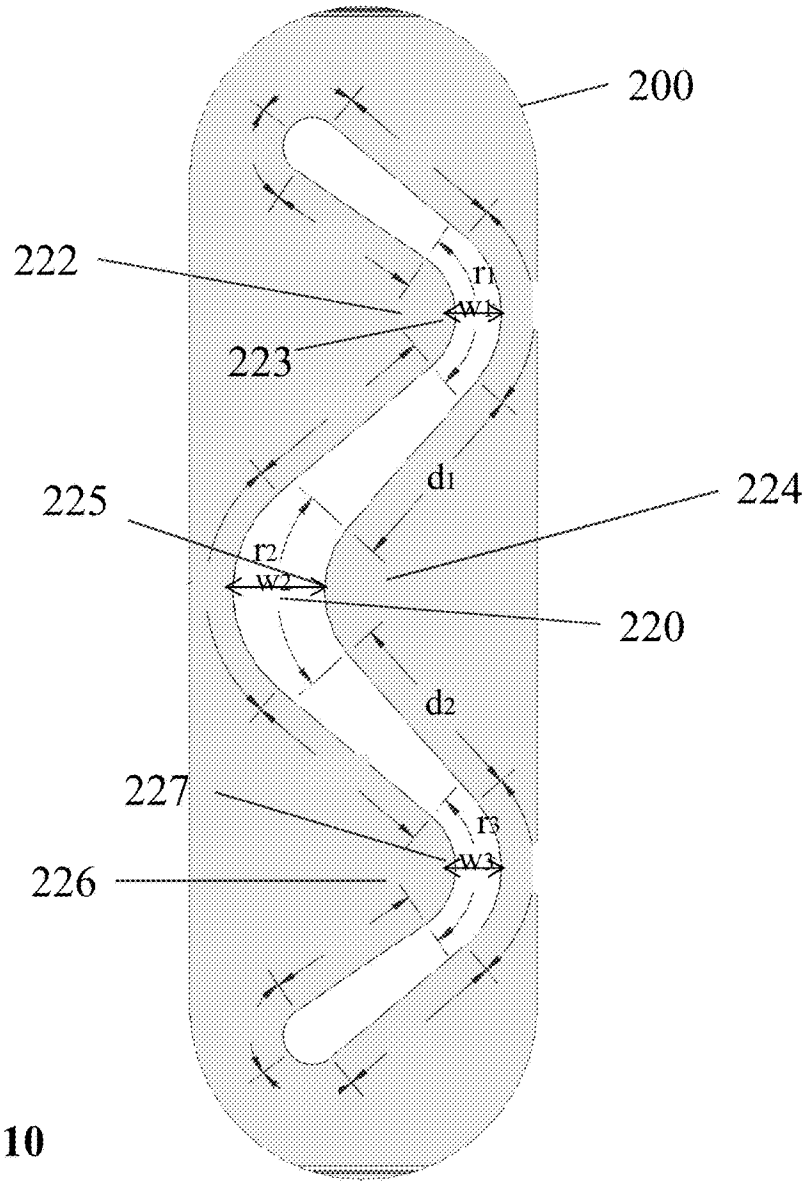
FIG. 10 is a plan view of the inner panel orifice of the lid assembly of FIG. 1A, according to the disclosed subject matter.

FIG. 10 is a plan view of an exemplary orifice 220 in accordance with the disclosed subject matter. For purpose of illustration and not limitation, as embodied herein, orifice 220 can defined through bottom surface 202 and top surface 204 of inner panel 200. As shown for example in FIG. 10, inner panel 200 can include a first finger 222, a second finger 224, and a third finger 226. First finger 222, second finger 224, and third finger 226 together define orifice 220 having a W-shape. First finger 222, second finger 224, and third finger 226 each includes an apex, where, for purpose of illustration and not limitation, apex 223 of first finger 222 and apex 227 of third finger 226 each is directed towards first longitudinal side 103 of frame 100, and apex 225 of second finger 224 is directed away from first longitudinal side 103 of frame 100.

With continued reference to FIG. 10, apex 223 of first finger 222 is defined by a first inside radius $r_1$, and apex 225 of second finger 224 is defined by a second inside radius $r_2$. For purpose of illustration and not limitation, as embodied herein, first inside radius $r_1$ is less than second inside radius $r_2$. Apex 227 of third finger 226 is defined by a third inside radius $r_3$, and as embodied herein, third inside radius $r_3$ is less than second inside radius $r_2$. Additionally or alternatively, and as embodied herein, first inside radius $r_1$ can be equal to third inside radius $r_3$. The radius configurations described herein can thus be configured to separate individual sheets of material from each other when dispensing the sheets through orifice 220. First inside radius $r_1$, second inside radius $r_2$, and/or third inside radius $r_3$, if too small, can cause the sheets of material to bind in orifice 220, yet if too large can cause the sheets of material to rope, e.g., by not separating the sheets when passing through orifice 220.

Referring still to FIG. 10, orifice 220 can define a width $w_1$ proximate apex 223 of first finger 222, a width $w_2$ proximate apex 225 of second finger 224, and a width $w_3$ proximate apex 227 of third finger 226. For purpose of illustration and not limitation, as embodied herein, $w_2$ can be about twice the width of $w_1$ or $w_3$. Additionally or alternatively, as embodied herein, $w_1$ can be about equal to $w_3$. The configuration of widths can help spread the sheet of material across the entire orifice 220, and thus lessen or prevent binding or clumping of the sheet of material when passed through orifice 220. Additionally or alternatively, the configuration of widths can allow the inner panel 200 to flex proximate apex 223, 225 and/or 227 when the sheet of material is passed through orifice 220, which can thus lessen or prevent binding or clumping of the sheet of material. In addition, or as a further alternative, the larger width $w_2$ of apex 225 proximate the middle of orifice 220 can allow feeding of the sheet of material therethrough more easily, while the narrowing of the orifice toward apex 223 and 227 can spread the sheet of material across orifice 220 to reduce or prevent binding or clumping.

Additionally, and as embodied herein, orifice 220 can define a dimension $d_1$ between apex 223 of first finger 222 and apex 225 of second finger 224 and a dimension $d_2$ between apex 225 of second finger 224 and apex 227 of third finger 226. For purpose of illustration and not limitation, as embodied herein, orifice 220 can taper along dimension $d_1$ from apex 225 of second finger 224 toward apex 223 of first finger 222. Additionally or alternatively, and as embodied herein, orifice 220 can taper along dimension $d_2$ from apex 225 of second finger 224 toward apex 227 of third finger 226. In addition, or as a further alternative, and as embodied herein, orifice 220 can taper from a first end toward apex 223 of first finger 222 and/or from a second end toward apex 227 of third finger 226.

Figure 11:
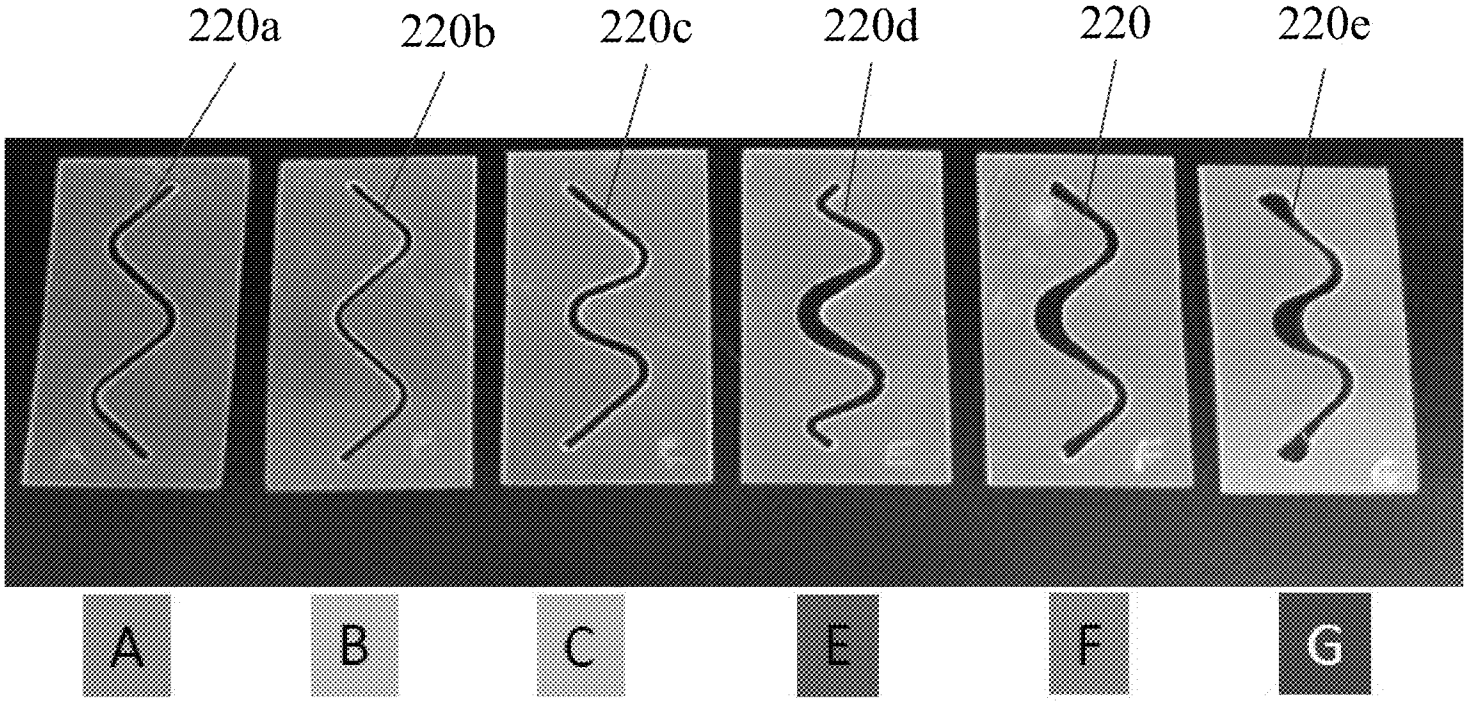
FIG. 11 is a perspective view of alternative embodiments of inner panel orifices, shown side-by-side with the inner panel orifice of FIG. 1A for purpose of illustration and comparison, according to the disclosed subject matter.

Inner panel 200 can have any configuration of orifice described herein. FIG. 11 shows alternative embodiments of orifices 220*a*, 220*b*, 220*c*, 220*d* and 220*e* in accordance with the disclosed subject matter, side-by-side with orifice 220 for purpose of illustration and comparison. For example and without limitation, and as embodied herein, orifices 220*a*, 220*b* and 220*c* each can have a substantially uniform width from a first end thereof to an opposing second end thereof. Alternatively, as embodied herein, orifices 220, 220*d*, and 220*e* each can have varying widths from a first end thereof to an opposing second end thereof.

Figure 12:
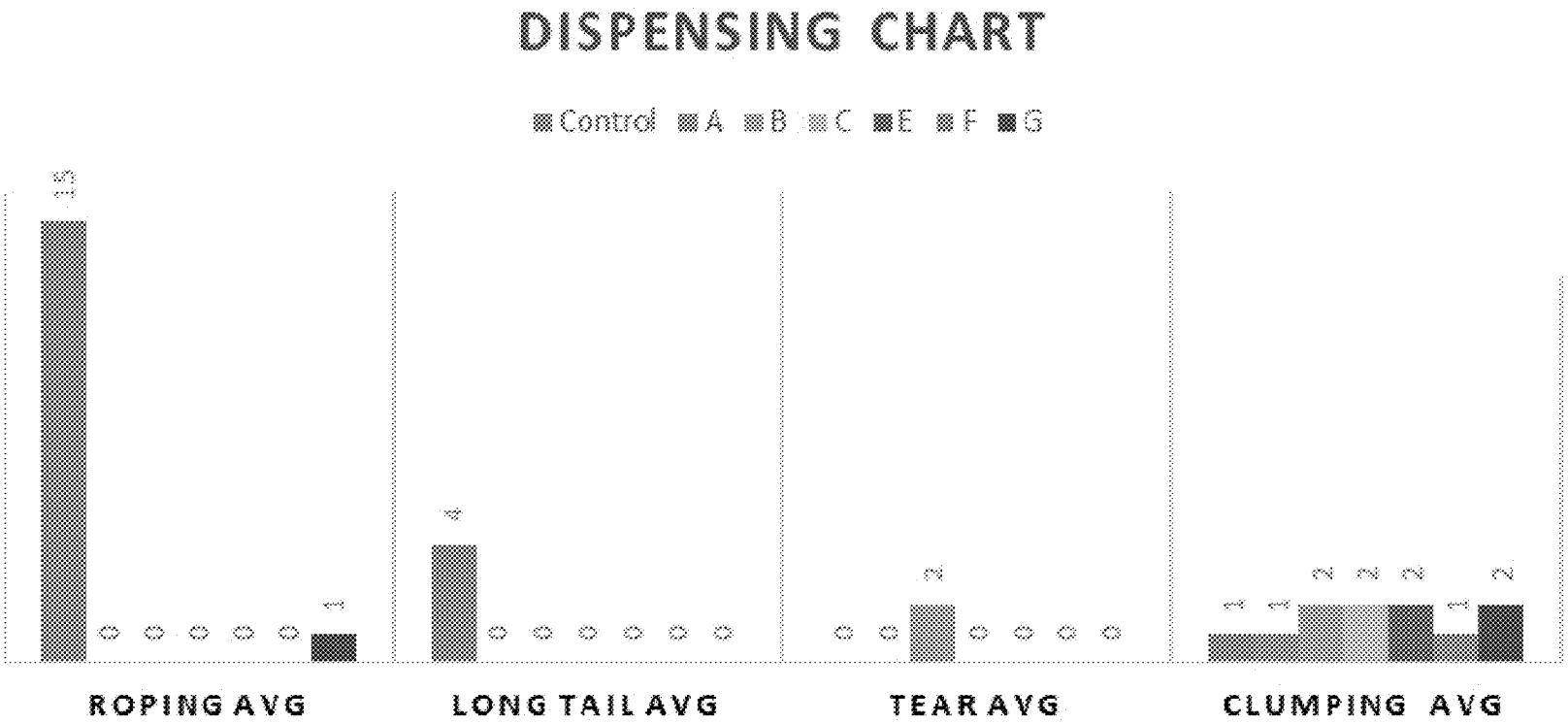
FIG. 12 is a diagram illustrating testing data of the inner panel orifices of FIG. 11, for purpose of illustration and comparison, according to the disclosed subject matter.

FIG. 12 is a diagram illustrating testing data of the orifices 220, 220*a*, 220*b*, 220*c*, 220*d* and 220*e* of FIG. 11, for purpose of illustration and comparison, according to the disclosed subject matter. A lid assembly 1000 was configured having each orifice 220, 220*a*, 220*b*, 220*c*, 220*d* and 220*e* and used to dispense the 12 sheets of wet wipes, and the numbers of roping, long tail, tearing and clumping events were counted during dispensing of the sheets. As shown in FIG. 12, orifice 220 had the same number or fewer events of roping, long tail, tearing and clumping compared to each other orifice.

Figure 13:
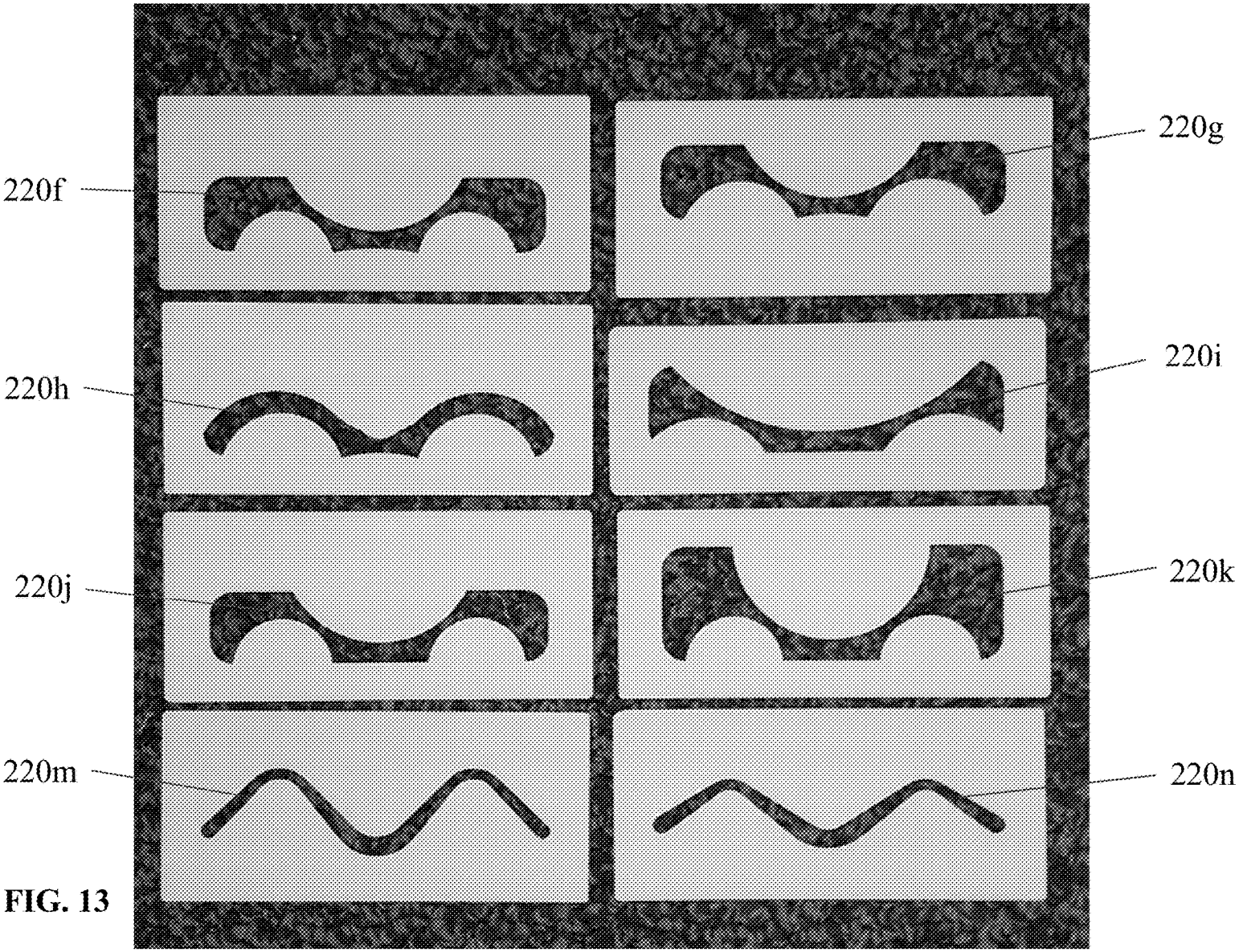
FIG. 13 is a plan view of alternative embodiments of inner panel orifices, according to the disclosed subject matter.

FIG. 13 shows alternative embodiments of orifices 220*f*, 220*g*, 220*h*, 220*i*, 220*j*, 220*k*, 220*m* and 220*n* in accordance with the disclosed subject matter. Inner panel 200 can be configured having any of these alternative orifice configurations. The inner panels with orifices 220*f*, 220*g*, 220*h*, 220*i*, 220*j*, and 220*k* have fingers with circular shapes. The first and third fingers of the panels of 220*f*, 220*g*, and 220*h* have a curved side therebetween the first and third respective fingers, whereas the first and third fingers of the panels of 220*i*, 220*j*, and 220*k* have a straight edge side therebetween. A further suitable orifice is disclosed in a related copending design application of even date by the same inventors of the instant disclosure, entitled "Container Lid Assembly," the contents of which is incorporated by reference herein in its entirety.

The lid assembly can be manufactured by any known method, such as but not limited to, injection molding, thermoform, compression molding, or co-injection molding. The components of the lid assembly and can be made of any suitable material or mixture of materials, including but not limited to polymeric materials, such as flexible resin materials and/or rigid resin materials. For example and not limitation, the frame, inner panel and cover panel can be made from the same materials or different materials depending on the desired application. For example, the cover panel can be made from a relatively rigid material to protect the contents of the container, while the frame and inner panel can be made from relatively flexible materials to allow for flexing during opening, closing and/or dispensing.

While the disclosed subject matter is described herein in terms of certain embodiments, those skilled in the art will recognize that various modifications and improvements can be made to the disclosed subject matter without departing from the scope thereof. Moreover, although individual features of one embodiment of the disclosed subject matter can be discussed herein or shown in the drawings of the one embodiment and not in other embodiments, it should be apparent that individual features of one embodiment can be combined with one or more features of another embodiment or features from a plurality of embodiments.

In addition to the various embodiments depicted and claimed, the disclosed subject matter is also directed to other embodiments having any other possible combination of the features disclosed and claimed herein. As such, the particular features presented herein can be combined with each other in other manners within the scope of the disclosed subject matter such that the disclosed subject matter includes any suitable combination of the features disclosed herein. Thus, the foregoing description of specific embodiments of the disclosed subject matter has been presented for purposes of illustration and description. It is not intended to be exhaustive or to limit the disclosed subject matter to those embodiments disclosed.

It will be apparent to those skilled in the art that various modifications and variations can be made in the device and method of the disclosed subject matter without departing from the spirit or scope of the disclosed subject matter. Thus, it is intended that the disclosed subject matter include modifications and variations that are within the scope of the appended claims and their equivalents.

What is claimed is:

1. A lid assembly for a container, comprising:

a frame including an exterior surface, the exterior surface having a frame latching member extending outwardly therefrom, wherein the frame latching member includes a frame projection;

an inner panel hingedly coupled to the frame along a first longitudinal side thereof and movable between a closed position and an open position, the inner panel including a bottom surface, a top surface, and a sidewall extending outwardly from a perimeter of the top surface, the top surface having a panel latching member extending outwardly therefrom, the inner panel defining an orifice extending between the bottom surface and the top surface, wherein the panel latching member includes a biasing member having a panel projection, wherein the frame projection and the panel projection are lockable when the inner panel is in the closed position and the frame projection is disposed between a base of the biasing member and the panel projection when the inner panel is in the closed position to lock the inner panel with the frame; and a cover panel hingedly coupled to the frame along a second longitudinal side thereof opposite the first longitudinal side.

2. The lid assembly of claim 1, wherein the inner panel is hingedly coupled to the frame by at least one of a living hinge, a butterfly hinge, a bi-fold hinge, a butt hinge, a concealed hinge, or a continuous hinge.

3. The lid assembly of claim 1, wherein the cover panel is hingedly coupled to the frame by at least one of a living hinge, a butterfly hinge, a bi-fold hinge, a butt hinge, a concealed hinge, or a continuous hinge.

4. The lid assembly of claim 1, wherein the frame defines an orifice therein, the orifice of the frame being larger than the orifice of the inner panel.

5. The lid assembly of claim 1, wherein a surface area of the frame is less than a surface area of the inner panel.

6. The lid assembly of claim 1, wherein the lid assembly is configured to be coupled to a container for dispensing wipes.

7. The lid assembly of claim 1, wherein the cover panel includes a cover latching member extending outwardly from an inner surface thereof, the cover latching member disposed along a free end, wherein the frame is moveable between a closed position and an open position, wherein the frame includes a frame sidewall having a projection, wherein the cover latching member is lockable with the projection of the frame sidewall when the inner panel is in the closed position to lock the cover with the frame.

8. The lid assembly of claim 1, wherein the inner panel is unlocked from the frame by a force applied towards the orifice of the inner panel and against the panel projection of the panel latching member.

9. The lid assembly of claim 1, wherein the frame projection and the panel projection have cammed surfaces.

10. The lid assembly of claim 1, wherein the inner panel includes a first finger, a second finger, and a third finger, wherein the first finger, the second finger, and the third finger define a first the orifice between the bottom surface and the top surface of the inner panel.

11. The lid assembly of claim 10, wherein each of the first finger, the second finger, and the third finger includes an apex, wherein the apex of the first finger and the third finger is directed towards the first longitudinal side of the frame and the apex of the second finger is directed away from the first longitudinal side of the frame.

12. The lid assembly of claim 11, wherein the apex of the first finger is defined by a first inside radius and the apex of the second finger is defined by a second inside radius, and wherein the first inside radius is less than the second inside radius.

13. The lid assembly of claim 11, wherein the apex of the third finger is defined by a third inside radius and the apex of the second finger is defined by a second inside radius, and wherein the third inside radius is less than the second inside radius.

14. The lid assembly of claim 4, wherein the orifice of the inner panel at least partially obstructs the orifice of the frame when the inner panel is in the closed position.

15. The lid assembly of claim 1, wherein a width dimension of the orifice of the inner panel at an apex of the second finger is twice a width dimension of the orifice of the inner panel at either of an apex of the first finger or an apex of the third finger.

16. The lid assembly of claim 10, wherein the orifice of the inner panel has a W shape.

17. The lid assembly of claim 10, wherein a dimension of the orifice of the inner panel tapers from an apex of the second finger to an apex of the first finger, and wherein a dimension of the first orifice of the inner panel tapers from the apex of the second finger to an apex of the third finger.

18. The lid assembly of claim 10, wherein a width of the orifice of the inner panel is consistent from a first end of the orifice of the inner panel to a second end of the orifice of the inner panel, wherein the second end is opposite the first end.

19. The lid assembly of claim 6, wherein the orifice of the inner panel is aligned with the orifice of the frame in the closed position and the orifice of the inner panel and the orifice of the frame are configured to permit a dispensing wipe therethrough.

20. The lid assembly of claim 6, wherein the cover panel is configured to protect contents within the container.

* * * * *